United States Patent [19]

Myers

[11] 4,049,430

[45] Sept. 20, 1977

[54] PRECIPITATION HARDENABLE STAINLESS STEEL

[75] Inventor: Lewis P. Myers, Reading, Pa.

[73] Assignee: Carpenter Technology Corporation, Reading, Pa.

[21] Appl. No.: 715,619

[22] Filed: Aug. 18, 1976

[51] Int. Cl.[2] ..... C22C 38/06; C22C 38/42

[52] U.S. Cl. ..... 75/124; 75/125; 75/128 F; 75/128 G; 75/128 P; 148/37

[58] Field of Search ..... 75/124, 125, 128 G, 75/128 F, 128 P; 148/37, 38

[56] References Cited

U.S. PATENT DOCUMENTS

| | | | |
|---|---|---|---|
| 3,357,868 | 12/1967 | Tanczyn | 148/37 |
| 3,408,178 | 10/1968 | Myers | 75/125 |
| 3,556,776 | 1/1971 | Clarke, Jr. | 75/124 |
| 3,622,307 | 11/1971 | Clarke, Jr. | 75/125 |
| 3,658,513 | 4/1972 | Clarke, Jr. | 75/124 |

*Primary Examiner*—Arthur J. Steiner
*Attorney, Agent, or Firm*—Edgar N. Jay

[57] ABSTRACT

A chromium-nickel age hardenable martensitic stainless steel containing about up to 0.05% carbon, up to about 0.5% manganese, up to about 0.5% silicon, up to about 0.04% phosphorus, up to about 0.02% sulfur, about 10.5–12% chromium, about 8.5–9.5% nickel, about 2.1–3.0% copper, about 0.7–0.93% aluminum, up to about 0.01% boron, about 0.20–0.55% columbium, and the balance iron plus impurities.

18 Claims, No Drawings

PRECIPITATION HARDENABLE STAINLESS STEEL

BACKGROUND OF THE INVENTION

This invention relates to chromium-nickel stainless steel and, more particularly, to a martensitic chromium-nickel steel which, in its annealed condition, can readily be shaped into a wide variety of parts and which, when age hardened, displays an unusual combination of readily attained hardness, strength, notch strength and toughness.

The outstanding aged hardness and strength of the alloy disclosed in U.S. Pat. No. 3,408,178, granted to L. P. Myers and K. J. Goda, Jr. on Oct. 29, 1968 and assigned to the assignee of this application, largely account for the commercial acceptance that alloy has achieved. It is also believed that the titanium present in that alloy contributes, to a major extent, to the attainment of the alloy's outstanding properties, but, because residual elements such as carbon, nitrogen and sulfur should be kept very low (e.g. less than 0.01%) in such titanium strengthened alloys, the resultant relatively high cost of the alloys has detracted from its general usefulness. At the present time, there is a substantial need for an alloy which is not so expensive to make and use, but yet has a good combination of mechanical and chemical properties. For example, the textile industry requires an alloy for making such parts as spinnerets and pack parts characterized by relatively low cost but capable of being hardened to at least Rockwell C 44, and, in that condition, having an impact strength in the longitudinal direction of at least 15 ft-lb and at least 5 ft-lb in the transverse direction, a 0.2% yield strength of at least about 200,000 psi and an ultimate tensile strength of at least about 210,000 psi. The ratio of notch tensile strength to ultimate tensile strength (NTS/UTS) of the alloy should be at least equal to one. The alloy in its annealed and unhardened condition, should be soft enough so that it can be shaped to form the desired parts.

BRIEF SUMMARY OF THE INVENTION

The present invention stems from the discovery that when the elements chromium, nickel, copper, aluminum, columbium and iron are balanced within the limits to be defined hereinafter, an alloy is provided having an outstanding combination of hardenability, strength, ductility, toughness and impact strength in conjunction with good corrosion resistance without the cost and other problems associated with the presence of titanium in age hardenable stainless steel, so that the alloy is well suited for a wide variety of uses.

The alloy of the present invention is especially well suited for use in making parts such as spinnerets and pack parts used in the textile industry in the manufacture of synthetic fibers. Such parts formed from the present alloy have sufficient strength, toughness, hardness and corrosion resistance so that they can withstand the high internal operating pressure to which they may be subjected in use, are resistant to damage such as might occur to a relatively soft part during normal maintenance, and can be exposed to temperatures as high as 1000° F (540° C) when being cleaned without objectionable corrosion.

Important advantages of the present invention are attained by providing an alloy which in its broad range consists essentially in weight percent of about

| | w/o |
|---|---|
| Carbon | Up to 0.05 |
| Chromium | 10.5–12 |
| Nickel | 8.5–9.5 |
| Copper | 2.1–3.0 |
| Aluminum | 0.7–0.93 |
| Columbium | 0.20–0.55 |
| Boron | Up to 0.01 |

and the balance iron except for incidental impurities and such additions as do not significantly impair the desired properties. Such elements as manganese, silicon, phosphorus, sulfur and nitrogen are not desired additions in this alloy. Thus manganese and silicon are each limited to no more than about 0.5%, phosphorus is limited to no more than about 0.04%, sulfur is limited to no more than about 0.02% and nitrogen is limited to no more than 0.04%. When it is desired to impart free machining properties to the alloy, one or more known free machining additions, e.g. sulfur up to about 0.3%, may be added but, as a consequence, the toughness or impact strength of the material may be substantially reduced because of the embrittling effect usually associated with such additions.

DESCRIPTION OF THE PREFERRED EMBODIMENTS

The alloy is balanced within the stated range so as to be essentially martensitic, that is no more than about 5%, preferably about no more than about 3%, retained austenite when heat treated and aged, although in the event the austenite present is uniformly dispersed and the material is free of banding, then as much as about 10% austenite can be tolerated. Ferrite, if present, should not be more than a trace, that is, no more than about 3%. This required microstructure is primarily established by the elements chromium, nickel, copper and aluminum; while carbon and nitrogen are carefully controlled because of their powerful effect on the microstructure of the composition. Carbon can range up to about 0.05% but it is a feature of this alloy that carbon need not be driven down to extremely low levels to achieve its best properties which can be attained with carbon ranging from 0.01–0.04% and contributing to the impact strength of the alloy. On the other hand, nitrogen which, like carbon, is also a powerful austenite former, is not desired in this alloy and is preferably limited to no more than about 0.01% when the best properties are wanted although as much as 0.04% may be tolerated.

At each level, within the stated ranges, the balance of elements is adjusted to provide the martensitic microstructure characteristic of this alloy. Manganese and silicon are each preferably limited to about 0.25%, and, for best results including impact strength, manganese and silicon are each limited to no more than 0.15%. Phosphorus is preferably limited to no more than 0.03%, and sulfur to no more than 0.01%. Chromium contributes corrosion resistance, and, for best results, a minimum of about 10.75%, and better yet 11.00% is used. Because chromium is a ferrite former and tends to stabilize austenite, it is preferably limited to no more than 11.75%, better yet 11.50%. Nickel may result in the presence of excessive retained austenite unless it is carefully controlled. Thus, nickel is preferably limited to no more than 9.25% or, better yet, to no more than 9.10%. Because nickel contributes to the impact toughness of the composition and is believed to take part in the hardening mechanism of the alloy, a minimum of 8.70% is preferably present.

Copper and aluminum are both involved in the hardening mechanism of the alloy; however, copper is an austenite former, and aluminum is a ferrite former, thus, the amount of each used must be carefully controlled. While aluminum contributes to the hardness of the alloy, unlike titanium, it does not form deleterious carbides in this alloy. This makes it advantageous to use 0.01–0.04% carbon for its beneficial effect in this alloy and obviates the expense incident to maintaining carbon below 0.01%. Preferably, copper is present in an amount of at least 2.20% to ensure the minimum desired hardness and, to minimize the amount of retained austenite, is preferably limited to about 2.70% and, better yet, to about 2.60%. In this composition, at least about 0.7% aluminum is required together with the stated amount of copper to attain the desired aged hardness of $R_c$44, and a minimum impact strength of at least 15 ft-lb in the longitudinal direction and at least 5 ft-lb in the transverse direction. Preferably, at least about 0.75% aluminum is used for this purpose and, better yet, at least about 0.80%. Because of the adverse effect of excessive aluminum, particularly on the impact strength of the alloy, the upper limit of 0.93% aluminum should not be exceeded by more than 0.01% or 0.02%.

Columbium is also an essential element in this composition because of its beneficial effect on impact toughness. For this purpose, at least 0.20% columbium is required, preferably 0.35%, and for best results at least 0.40% columbium is present. When the amount of columbium is increased above about 0.6% impact toughness is detrimentally affected and, for best results, the amount of columbium present is limited to no more than about 0.50%. The beneficial effect of columbium on the impact toughness of the alloy is accompanied by a small but definite increase in the aged hardness of the alloy.

Boron is not an essential element in the alloy of this invention and though it may be present in an amount up to about 0.01%, if desired, it can be limited to no more than the usual residual amount in stainless steel. However, boron is a desirable addition to this alloy because of its beneficial effect on impact toughness and, for this reason, preferably about 0.002 to 0.0055% boron is present in the alloy.

The alloy of this invention can be prepared and shaped using any suitable metallurgical processes and equipment. It is readily melted and cast as ingots which are wrought and shaped using well known techniques. As was pointed out hereinabove, residual elements such as manganese, silicon, phosphorus, sulfur and nitrogen are kept low for best results, but the alloy is readily prepared in electric arc furnaces with the desired mechanical and corrosion resistance properties specified. For best results, the alloy is prepared under a controlled atmosphere such as in a vacuum furnace.

The alloy can be hot worked at a temperature of about 1700° to 2300° F (925°–1260° C). Preferably, hot working is carried out from a temperature of about 2300° F except when necessary to reduce the residual heat in the workpiece. Annealing or solution treating is carried out at about 1400°–1700° F (760°–925° C). In this condition, the material is usually formed to the finished shape and then age hardened by heating for about 4 hours at about 900°–1000° F (482°–538° C). A somewhat higher aging temperature, up to about 1150° F (621° C) can be used when it is desired to maximize impact toughness but with some reduction in aged hardness.

The following examples are illustrative of the alloy of the present invention.

TABLE I

| | Ex. 1 | Ex. 2 | Ex. 3 | Ex. 4 | Ex. 5 |
|---|---|---|---|---|---|
| C | .016 | .021 | .021 | .023 | * |
| Mn | .03 | .25 | * | <.01 | * |
| Si | <.01 | .26 | * | <.01 | * |
| P | .008 | .003 | * | .003 | * |
| S | .005 | .005 | * | .003 | * |
| Cr | 11.23 | 11.72 | 11.74 | 11.39 | 11.42 |
| Ni | 9.34 | 9.04 | 9.09 | 8.92 | 8.96 |
| Cu | 2.25 | 2.81 | 2.81 | 2.38 | 2.41 |
| Al | .79 | .82 | .83 | .80 | .78 |
| B | .0018 | .0005 | .0026 | .0018 | .0046 |
| Cb | .24 | .25 | .25 | .45 | .44 |
| N | .007 | .017 | * | .003 | * |

*Not determined

In each of the Examples 1–5, the balance was iron except for incidental impurities which had no significant effect on the composition. Example 1 was prepared as a relatively large, about 11000 lb (4990 kg), vacuum induction heat while Examples 2, 3, 4 and 5 were prepared from small heats, about 17 lb (7.71 kg), melted in a vacuum induction furnace under argon. Examples 2–5 were made from split heats to facilitate showing the effect of columbium and boron on the properties of the alloy, Examples 2 and 3 were split from one heat and Examples 4 and 5 were split from another. Thus, the amounts of the elements not determined in the case of Examples 3 and 5 were not significantly different from the amounts of those elements present, respectively, in Examples 2 and 4.

Material from each of the heats was forged, annealed and formed into test specimens. The material for the specimens of Example 1 was annealed at 1525° F (830° C) between 3.5 and 6 hours followed by quenching in oil. The material for the specimens of Examples 2–5 were annealed at 1500° F (815° C) for 1 hour and water quenched. All specimens were aged at 950° F (510° C) for 4 hours. Room temperature smooth tensile property specimens had a 0.252 inch (0.64 cm) gage diameter and a 1-inch (2.54 cm) gage length. Notched tensile specimens had a diameter of 0.357 inch (0.907 cm) notched to a diameter of 0.252 inch, root radius of 0.001 inch (0.0025 cm) and a stress concentration factor of 10 ($K_t$=10).

The results of the tests given in Table II are the average of two tests except in the case of the V-notch Charpy impact tests where each is the average of three tests on longitudinal specimens. The 0.2% yield strength and ultimate tensile strength in thousands of pounds per square inch (KSI) are given under "0.2% YS" and "UTS" respectively. The percent elongation and reduction in area are given respectively under "% EL" and "% RA". Notch tensile strength is given under "NTS". Impact strength data was determined by means of the V-notch Charpy impact test and as aged hardness on the Rockwell C scale ($R_c$) is also given.

TABLE II

| Ex. No. | .2% YS (KSI) | UTS (KSI) | % EL | % RA | NTS (KSI) | V-notch Charpy (ft-lb) | Hard. ($R_c$) |
|---|---|---|---|---|---|---|---|
| 1 | 208 | 213.5 | 11.5 | 53 | 319 | 21 | 44.5 |
| 2 | 222.5 | 226.5 | 11 | 47 | 292.5 | 16 | 46 |
| 3 | 226.5 | 228 | 13.5 | 54 | 301.5 | 20.5 | 46 |
| 4 | 236 | 238.5 | 12 | 65 | 361.5 | 70 | 45 |
| 5 | 233.5 | 237 | 15 | 67.5 | 360 | 95 | 45.5 |

In adjusting the balance of the various elements within the broad range stated hereinabove, it is recognized that each element may be adjusted to within its preferred or best range individually or in combination with one or more of the remaining elements. For example, the preferred range of columbium of 0.35–0.55% or the best columbium range of 0.40–0.50%, with or without boron, can be used with the broad range of one or more or all of the remaining elements. It is also contemplated that the preferred (or best) minimums or maximums of one or more elements can be used with the broad maximums or minimums, as the case may be, of the remaining elements. For example, to adjust the balance of the composition so as to reduce the amount of retained austenite present in the alloy as defined by the broad ranges of the elements, it is contemplated that the nickel range may be adjusted to 8.5–9.25% or to 8.5–9.10% while leaving the ranges of the remaining elements as broadly stated. Other elements may be adjusted within the stated ranges so as to control the properties of the alloy as brought out hereinabove with regard to the effect of the elements as well as in keeping with good metallurgical practice.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A chromium-nickel stainless steel alloy capable of being age hardened to a hardness of at least 44 Rockwell C with an essentially martensitic microstructure having no more than about 10% retained austenite and no more than about 3% ferrite and in that condition having a 0.2% yield strength of at least about 200,000 psi, an ultimate tensile strength of at least about 210,000 psi, a notch tensile strength at least equal to its ultimate tensile strength, an impact strength in the longitudinal direction of at least 15 ft-lb and at least 5 ft-lb in the transverse direction, said alloy in weight percent consisting essentially of about

| | w/o |
|---|---|
| Carbon | up to 0.05 |
| Manganese | up to 0.5 |
| Silicon | up to 0.5 |
| Phosphorus | up to 0.04 |
| Sulfur | up to 0.02 |

-continued

| | w/o |
|---|---|
| Chromium | 10.5–12 |
| Nickel | 8.5–9.5 |
| Copper | 2.1–3.0 |
| Aluminum | 0.7–0.93 |
| Boron | up to 0.01 |
| Columbium | 0.20–0.55 |
| Nitrogen | up to 0.04 |

and the balance essentially iron and incidental impurities.

2. The alloy as set forth in claim 1 containing no more than about 0.25% manganese, no more than about 0.25% silicon, no more than about 0.01% sulfur, and no more than about 0.01% nitrogen.

3. The alloy as set forth in claim 1 containing about 0.01–0.04% carbon.

4. The alloy as set forth in claim 1 containing at least about 8.70% nickel.

5. The alloy as set forth in claim 1 containing no more than about 9.25% nickel.

6. The alloy as set forth in claim 1 containing no more than about 2.70% copper.

7. The alloy as set forth in claim 1 containing at least about 2.20% copper.

8. The alloy as set forth in claim 2 containing about 8.70–9.25% nickel, about 2.20–2.70% copper, about 0.75–0.93% aluminum, about 0.002–0.0055% boron, and about 0.35–0.55% columbium.

9. The alloy as set forth in claim 1 containing about 0.002–0.0055% boron.

10. The alloy as set forth in claim 1 containing at least about 0.35% columbium.

11. The alloy as set forth in claim 1 containing about 0.35–0.55% columbium and about 0.002–0.0055% boron.

12. The alloy as set forth in claim 2 containing no more than about 0.15% manganese, and no more than about 0.15% silicon.

13. The alloy as set forth in claim 12 containing about 8.70–9.10% nickel.

14. The alloy as set forth in claim 13 containing about 11.00–11.50% chromium and about 2.20–2.60% copper.

15. The alloy as set forth in claim 14 containing at least about 0.80% aluminum.

16. The alloy as set forth in claim 14 containing about 0.40–0.50% columbium and 0.002–0.0055% boron.

17. The alloy as set forth in claim 16 containing at least about 0.75% aluminum.

18. The alloy as set forth in claim 1 containing no more than about 9.10% nickel.

* * * * *